United States Patent [19]

Rittinge

[11] Patent Number: 4,528,787

[45] Date of Patent: Jul. 16, 1985

[54] BASE PLATE SYSTEM

[76] Inventor: Christer Rittinge, Nybrogatan 3, S-252 50 Helsingborg, Sweden

[21] Appl. No.: 593,405

[22] Filed: Mar. 26, 1984

[30] Foreign Application Priority Data

Mar. 24, 1983 [SE] Sweden ..... 8301623

[51] Int. Cl.[3] ..... E02D 27/00

[52] U.S. Cl. ..... 52/169.5; 52/101; 52/293; 52/302

[58] Field of Search ..... 52/101, 169.1, 169.5, 52/264, 265, 274, 287, 292, 293, 296, 302, 303, 310

[56] References Cited

U.S. PATENT DOCUMENTS

| | | | |
|---|---|---|---|
| 970,555 | 9/1910 | Riley | 52/296 |
| 2,126,664 | 8/1938 | Reis | 52/293 |
| 2,138,182 | 11/1938 | Lipthrott | 52/101 |
| 2,147,035 | 2/1939 | Henderson | 52/293 |
| 2,150,891 | 3/1939 | Tennison | 52/101 |
| 2,196,140 | 4/1940 | Coffman | 52/101 |
| 2,329,585 | 9/1943 | Brewer | 52/303 |
| 3,124,427 | 3/1964 | Chomes | 52/62 X |
| 3,170,269 | 2/1965 | Dunnington | 52/293 |
| 3,343,474 | 9/1967 | Sohda et al. | 98/31 |
| 3,388,514 | 6/1968 | Archinal | 52/293 X |
| 3,420,016 | 1/1969 | Findlay | 52/274 X |
| 3,513,586 | 5/1970 | Meyer et al. | 52/101 X |
| 3,601,942 | 8/1971 | Wilson | 52/293 X |
| 3,664,078 | 5/1972 | Merkin | 52/293 |
| 3,845,601 | 11/1974 | Kostecky | 52/290 |
| 4,185,429 | 1/1980 | Mendola | 52/274 |
| 4,237,664 | 12/1980 | Wilmes | 52/209 |
| 4,265,064 | 5/1981 | Parezo | 52/169.5 |

FOREIGN PATENT DOCUMENTS

| | | |
|---|---|---|
| 2304795 | 8/1974 | Fed. Rep. of Germany . |
| 2354861 | 5/1975 | Fed. Rep. of Germany . |
| 237147 | 4/1945 | Switzerland . |

*Primary Examiner*—Henry E. Raduazo
*Assistant Examiner*—Creighton Smith
*Attorney, Agent, or Firm*—Finnegan, Henderson, Farabow, Garrett & Dunner

[57] ABSTRACT

A base plate system comprises a timber base plate and a further base plate of a material resistant to corrosion and rot, preferably aluminum, placed between said first base plate and the foundation. Said further base plate has a channel cross-section and connected to this at several points on the circumference of said further base plate, connection pieces opening with their free ends into the atmosphere surrounding the foundation. Said further base plate has in its upper side continuous ducts and, between said ducts, upwardly extending, spaced apart distance means on which said timber base plate rests.

6 Claims, 4 Drawing Figures

BASE PLATE SYSTEM

The present invention relates to a base plate system comprising a timber base plate.

Many buildings erected directly on the ground, on a timber base plate system, are damaged by damp and mould first appearing on the timber base plate.

It is frequently impossible to repair these damages without dismounting the building. Although it is obvious that the damage to the timber base plate is initiated by poor ventilation, no usuable solutions to the problem have been found up to now.

The invention aims at providing such a solution, and to this end the invention has been given the characteristic features stated in the appended claims.

The invention will be described in detail below, reference being made to the accompanying drawings in which.

Figure 1:
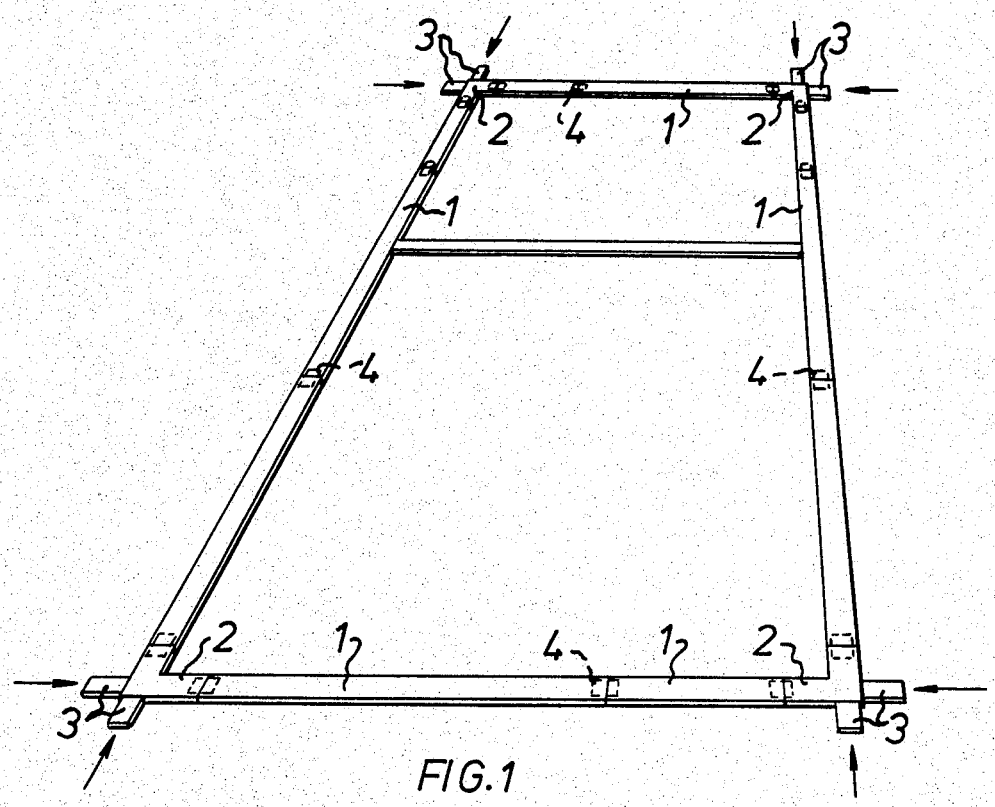
FIG. 1 shows a base plate for a system according to the invention.

The base plate system according to the invention comprises a base plate A of a corrosion and rot resistant material, preferably aluminum (alloy) and, mounted thereon, a conventional timber base plate B. The base plate A of the construction, here designed for a rectangular building foundation for a house without basement, is assembled of hollow details of the preferred aluminum material, viz. hollow section elements 1, hollow corner pieces 2 and connection pieces 3 connected to said corner pieces. The sides of the base plate A may consist of a single section element 1 or of several short section elements which are then interconnected by means of hollow jointing members 4 which are also used for connecting the hollow section elements to the corner pieces 2.

The base plate A has the same width as the timber base plate B, and the hollow section elements 1 may be internally divided, in their longitudinal direction, into several channels and may have in their upper side transversely and longitudinally spaced apart openings 5, here in the shape of slots, communicating with the channel/-channels of the hollow section element and, via these channels and via the hollow space of the corner pieces 2 and the connection pieces 3, with the atmosphere surrounding the house. The connection pieces 3 are inserted with a sliding fit in holes in the outer side of the arms of the corner pieces 2 and should be provided with a filter net 6. Also the corner pieces 2 may have such slots 5. Between the slots 5, there are provided on the upper side of the hollow section elements 1, upwardly extending distance means 7 which suitably consist of ridges extrusion molded in one piece with the hollow section elements 1 and defining between themselves air ducts, the upper side of which is defined by the bottom side of the conventional timber base plate B, and which ducts communicate with the atmosphere via the slots 5 and in this manner efficiently vent the timber base plate B over substantially its entire length, as illustrated by the arrows.

The hollow section elements 1 preferably have a cellular plastic insulation 8 in their long sides, said insulation being held in position by profile pieces extending from the channel side walls of the hollow section elements.

The base plate system according to the invention is assembled generally in the same way as conventional timber base plate systems. Thus the base plate A is placed on the conventional concrete foundation 9, having first laid a conventional steel band 10 and a nonageing rubber or asphalt mat insulation 11 on the foundation. The hollow section elements 1 and the corner pieces 2 are interconnected by means of the jointing members 4, and the connection pieces 3 are inserted in the corner pieces 2. The hollow section elements and possibly also the corner pieces are fastened to the foundation 9 by bolts 12. On the base plate A, the conventional timber base plate B is then placed, and with the conventional construction details mounted thereon, i.e. studding plus insulation 13, inner board with diffusion barrier 14, outer board 15 (for example asphaboard), extra insulation 16, if required, and face wall, such as brick 17, the connection pieces 3 being anchored in the bottom brick layer. The steel band 10 is nailed to the boards 14 and 15 and holds the construction together.

Figure 2:
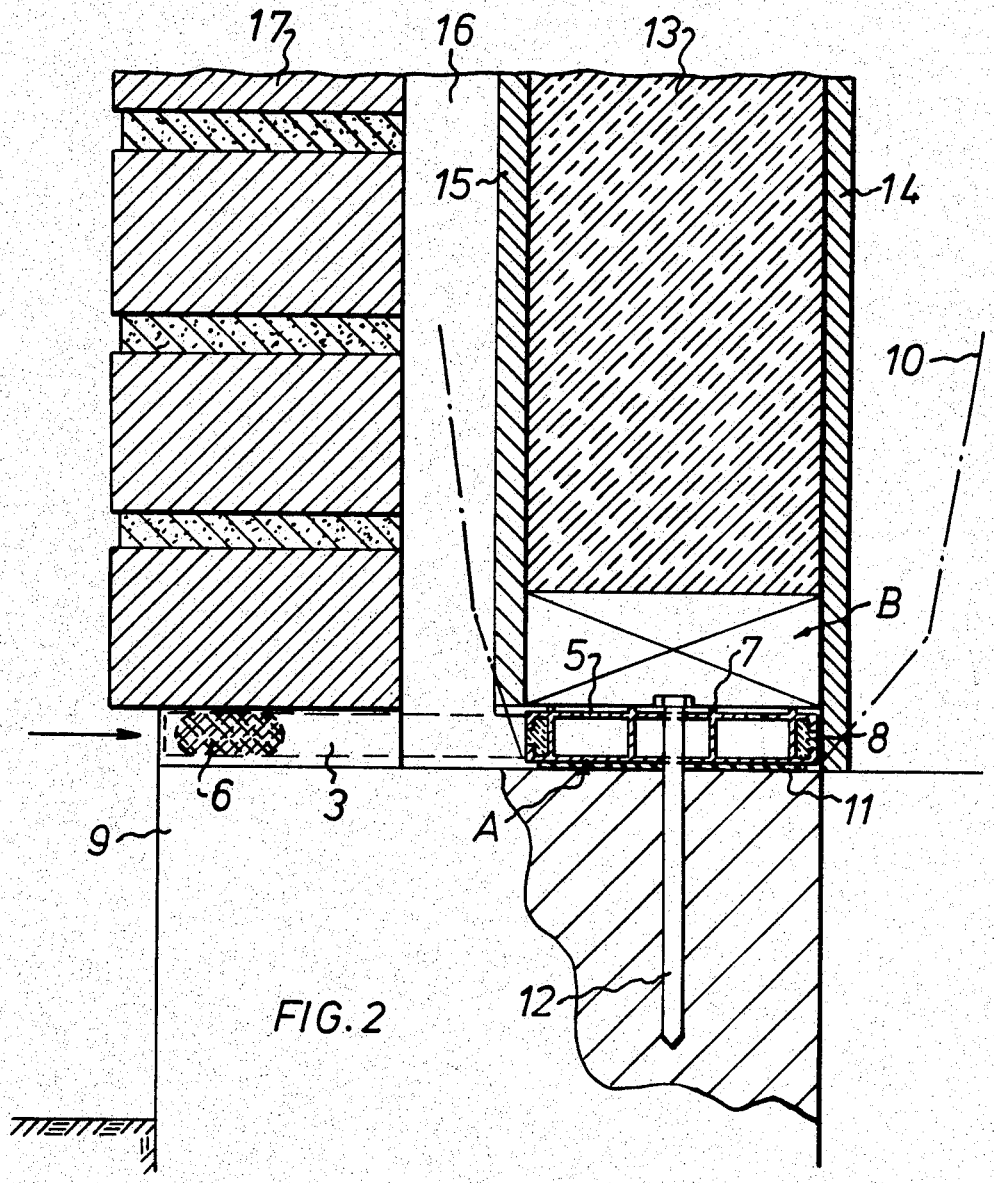
FIG. 2 shows an assembled base plate system according to the invention, in cross-section.
Figure 3:
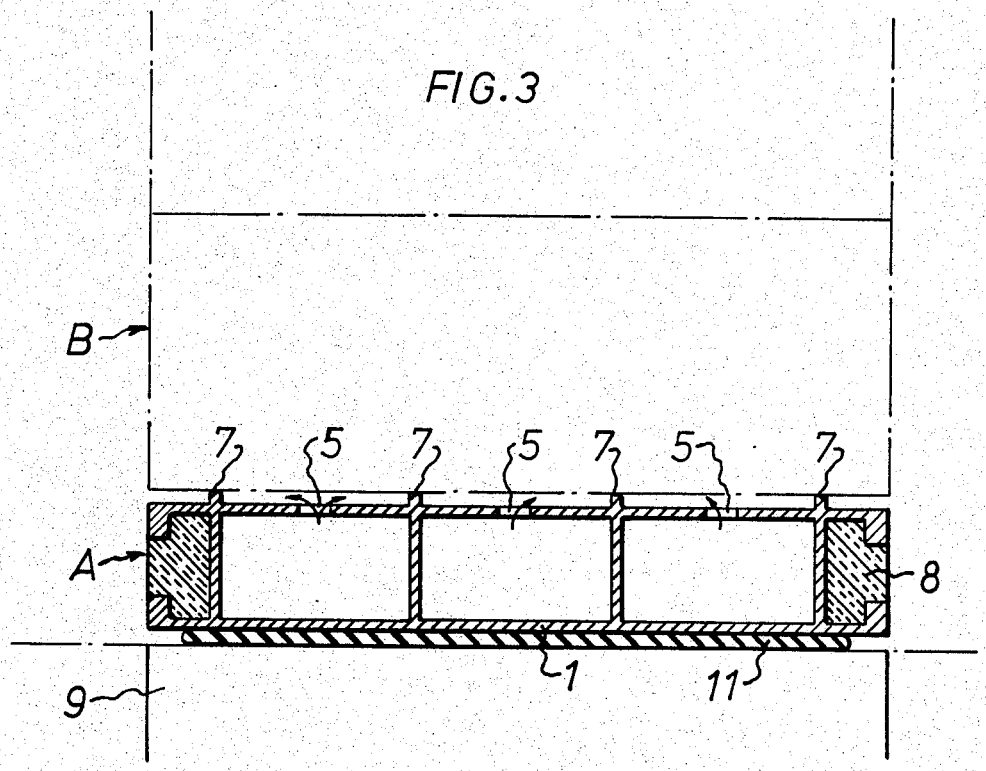
FIG. 3 shows the base plate system of FIG. 2 on a larger scale.
Figure 4:
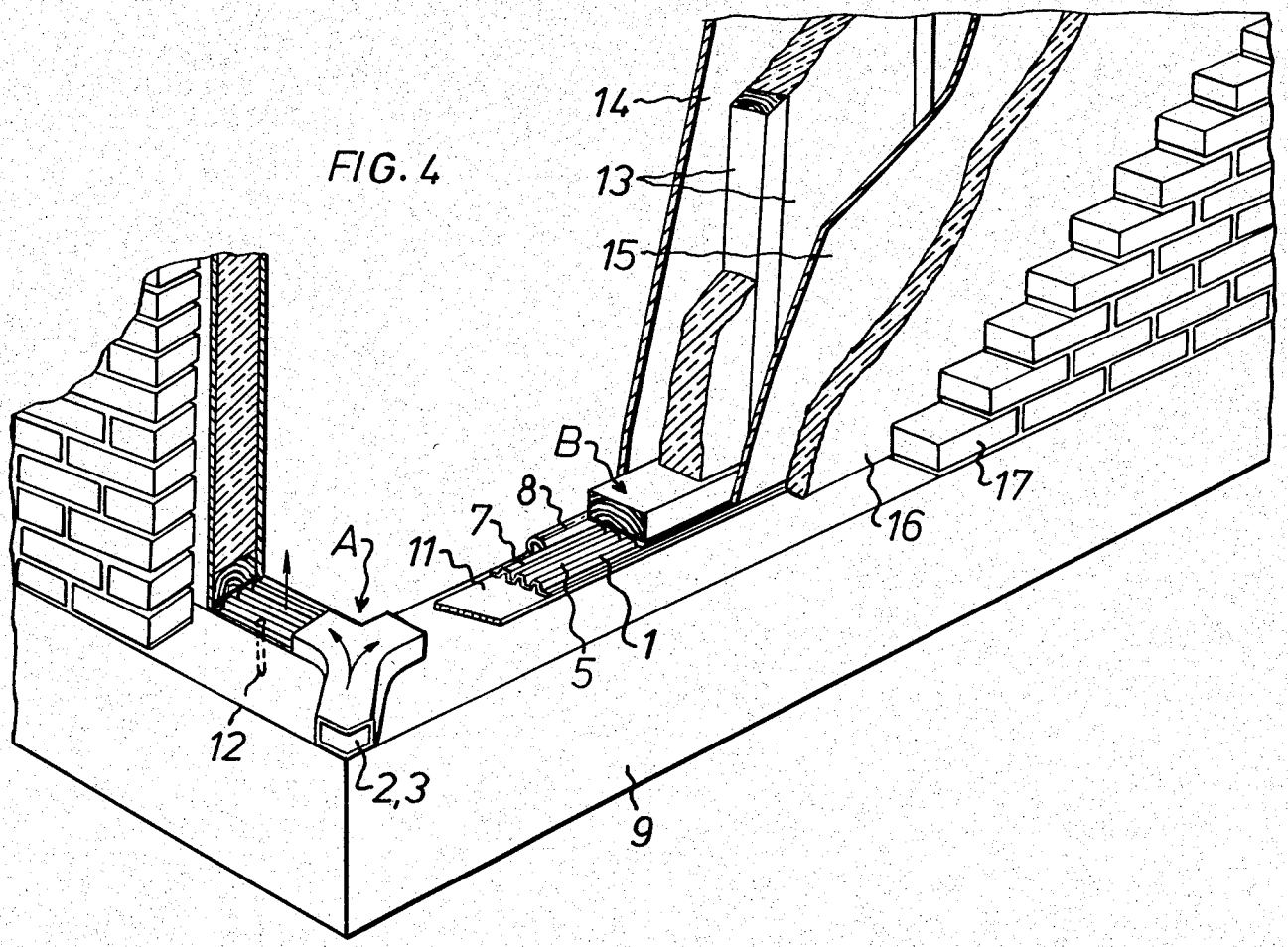
FIG. 4 shows an alternative embodiment of the base plate illustrated in FIG. 1.

FIG. 4 shows a base plate system with a modified embodiment of the base plate A, using for like details the same reference numerals as in FIGS. 1-3. The base plate A comprises elements 1 of corrugated, acid resistant, stainless steel, jointed by overlapping, which greatly facilitates assembly on the foundation in that no cutting of the elements 1 is required. At the corners of the building, the elements 1 are jointed by means of hollow corner pieces 2, 3 of plastic. The ridges of the corrugations may be said to be equivalent to the distance means 7 of the first embodiment and the valleys between the ridges define ventilating ducts for the timber base plate, said ventilating ducts communicating via the hollow spaces of the corner pieces 2, 3, with the atmosphere surrounding the house, thus providing for natural ventilation of the timber base plate B.

It should be pointed out that in both embodiments, the ventilating ducts are closed toward the foundation so that no moisture can from there enter the ventilating ducts and the timber base plate B.

At the erection of the building, fans may be connected, in both embodiments, to the corner pieces 2, 3 to start drying-out of the timber base plate B. Also wood preserving agents, fungicides etc. may be supplied in this manner.

What I claim and desire to secure by Letters Patent is:

1. A base plate system comprising a timber base plate, characterised in that it also comprises a further base plate of a corrosion and rot resistant material placed between the timber base plate and the foundation, said further base plate having a channel cross-section and connected to this, at several points on the circumference of said further base plate, connection pieces opening with their free ends into the atmosphere surrounding the foundation, and said further base plate having in its upper side continuous ducts and between said ducts upwardly extending, spaced apart distance means, on which said timber base plate rests.

2. A base plate system as claimed in claim 1, characterised in that said further base plate is assembled of elongate section elements and corner pieces having said connection pieces.

3. A base plate system as claimed in claim 1, characterised in that the distance means are in the form of ridges extrusion molded in one piece with said further base plate.

4. A base plate system as claimed in claims 1, characterised in that the elongate section elements are made of corrugated sheet metal.

5. A base plate system as claimed in claims 1, characterised in that said further base plate is made of aluminum, or stainless steel.

6. A base plate system as claimed in claim 2, characterized in that the distance means are in the form of ridges extrusion molded in one piece with said further base plate.

* * * * *